United States Patent [19]

Ogura

[11] 4,337,901

[45] Jul. 6, 1982

[54] DEVICE FOR DISPOSING OF GARBAGE

[75] Inventor: Katsumi Ogura, Nagoya, Japan

[73] Assignee: Tokyo Shibaura Denki Kabushiki Kaisha, Kawasaki, Japan

[21] Appl. No.: 120,873

[22] Filed: Feb. 12, 1980

[30] Foreign Application Priority Data

Feb. 17, 1979 [JP] Japan ..... 54-17456

[51] Int. Cl.[3] ..... B02C 18/42

[52] U.S. Cl. ..... 241/46 B; 241/100; 241/100.5

[58] Field of Search ..... 241/46 A, 46 B, 46.17, 241/46.08, 46.11, 100, 100.5

[56] References Cited

FOREIGN PATENT DOCUMENTS 54-6363 1/1979 Japan ..... 241/46 A 54-7771 1/1979 Japan ..... 241/100

*Primary Examiner*—Mark Rosenbaum

*Attorney, Agent, or Firm*—Cushman, Darby & Cushman

[57] ABSTRACT

A device for disposing of garbage comprising a garbage dividing mechanism disposed within a garbage dividing chamber and driven by a motor for finely dividing garbage, a rotary draining cylinder provided within said garbage dividing chamber to receive finely divided garbage from the garbage dividing mechanism and driven by the motor for causing the received garbage to be discharged from a garbage outlet of a divided garbage disposal chamber by centrifugal forces, and a garbage sack case supporting a garbage sack so that finely divided garbage discharged from said garbage outlet is received in said garbage sack and that a lower inner surface of the sack is downwardly inclined toward one end to define a inclined flow path.

7 Claims, 1 Drawing Figure

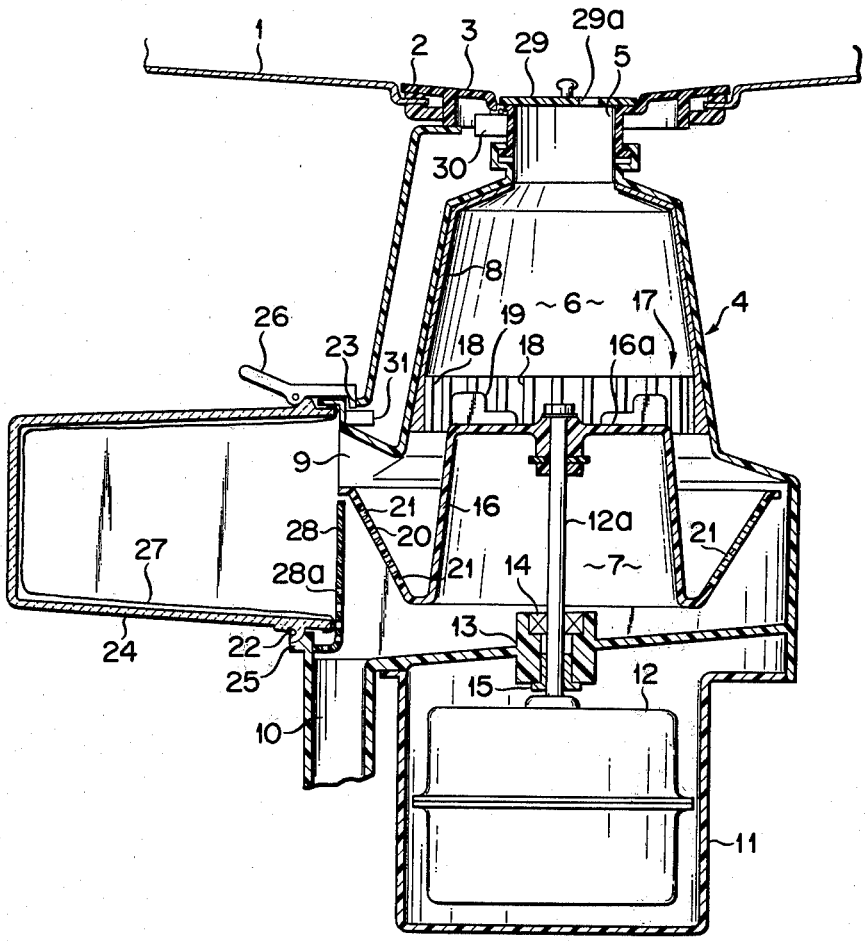
1
2
3
29
29a
5
30
8
26
23
31
19
~6~
17
4
18
18
16a
9
21
16
12a
28
20
21
21
27
28a
14
~7~
13
24
22
25
15
12
10
11

DEVICE FOR DISPOSING OF GARBAGE

This invention relates to a device for disposing of kitchen garbage by finely dividing it and charging it into a sack.

As the prior-art device for disposing of kitchen garbage produced in a kitchen sink hopper, one which is provided under the outlet of the hopper and is constructed such as to finely divide garbage which is charged from the outlet and then to discharge it together with sink water flowing down from the aforesaid outlet into a drainpipe, is well known. Recently, there has also been provided a kitchen garbage disposal device, with which garbage finely divided is not discharged to the drainpipe but is charged into a garbage sack and taken away therewith. The kitchen garbage disposal device of this sort, however, has a drawback that sink water is charged together with the finely divided garbage into the garbage sack and retained there, this means that the quantity of garbage charged into the sack is reduced by the sink water.

The invention is intended in the light of the above affairs, and its object is to provide a garbage proposal device, which can prevent sink water from remaining in the garbage sack.

In an aspect of the present invention there is provided a device for disposing of garbage comprising:

a case having an upper garbage inlet section, a garbage dividing chamber defined under and communicating with said garbage inlet section and a divided garbage disposal chamber defined under and communicating with said garbage dividing chamber, said divided garbage disposal chamber having a garbage outlet formed in its peripheral wall and a draining port;

a motor;

a garbage dividing mechanism disposed within said garbage dividing chamber and driven by said motor for finely dividing garbage;

a rotary draining member provided within said garbage dividing chamber to receive finely divided garbage from said garbage dividing mechanism and driven by said motor for causing the received garbage to be discharged from said garbage outlet by centrifugal forces; and a garbage sack case supporting a garbage sack so that finely divided garbage discharged from said garbage outlet is received in said garbage sack and that an inclined flow path for draining away water entering said garbage sack is defined.

This invention can be more fully understood from the following detailed description when taken in conjunction with the accompanying drawings, in which:

the drawing is a sectional view showing an embodiment of the invention.

An embodiment of the invention will now be described with reference to the accompanying drawing. Designated at 1 is a kitchen sink hopper having an outlet 2, through which garbage is discharged. Designated at 3 is a coupling member mounted on the edge of the outlet 2, at 4 is a cylindrical plastic case depending from the coupling member 3. The case 4 has an upper garbage inlet section 5 communicating with the outlet 2 via the coupling member 3, a garbage dividing chamber 6 formed under and communicating with the garbage inlet section 5 and a divided garbage disposal chamber 7 formed under and communicating with the garbage dividing chamber 6. The garbage dividing chamber 6 has a flaring form with its diameter increased toward the bottom, and it is lined with a metal member 8. The divided garbage disposal chamber 7 has a peripheral wall greater in diameter than the garbage dividing chamber 6 and having a garbage outlet 9 (formed in a left hand portion in the Figure), and an inclined bottom wall having a draining port 10 formed in the lowermost portion thereof (left end portion in the Figure). Designated at 11 is a motor case secured to the underside of the case 4 and accommodating a motor 12 having a vertical shaft **12*a* extending through a bearing cylinder 13 formed at the bottom of the divided garbage disposal chamber 7 and also through the divided garbage disposal chamber 7 into the garbage dividing chamber 6. Designated at 14 and 15 are respectively a water seal member and a metal bearing both provided between the inner periphery of the bearing cylinder 13 and the shaft 12*a*. Designated at 16 is a flinging cylinder closed at the top 16*a*, the center of which is mounted on the end of the shaft 12*a* of the motor 12 extending in the garbage dividing chamber 6, and a portion of the shaft 12*a* extending through the garbage disposal chamber 7 and the bearing cylinder 3 are covered by the flinging member 16. Designated at 17 is a garbage dividing mechanism provided within the garbage dividing chamber 6 and comprising stationary blades 18 and rotary blades 19. The stationary blades 18 are installed at a uniform interval on the inner peripheral wall of the garbage dividing chamber 6, and the rotary blades 19 are installed also at a uniform interval on the top wall 16*a* of the flinging cylinder 16. Designated at 20 is a rotary draining cylinder having an inverted frustconical form connected to the lower end of the flinging cylinder 16 located within the rubbish dividing chamber 7 and upwardly flaring. The rotary draining cylinder 20 has a number of draining holes 21 formed over the entire area of it. Designated at 22 is a pin extending adjacent to the lower edge of the garbage outlet 9, at 23 a hole formed adjacent to the upper edge of the garbage outlet 9, and at 24 a garbage sack case removably mounted on the garbage outlet 9. The garbage sack case 24 has a bottom and a cylindrical peripheral wall gently flaring from the bottom toward the open end. It is provided on the outer periphery adjacent to the open end with an engagement piece 25 removably engaging with the pin 22 and rotatably thereabout in the engaging state. It is also provided on the side opposite the engagement piece 25 with a pivotal hook member 26 which can be engaged in the hole 23. The sack case 24 is mounted by first engaging the engagement piece 25 with the pin 22 and then engaging the pivotal hook member 26 in the hole 23, and in its mounted state as shown in the Figure the lower portion of its inner peripheral wall has a downward slope toward the garbage outlet 9. Designated at 27 is a garbage sack inserted in the sack case 24 before mounting the case 24. It is supported by the sack case 24 such that its open end faces the garbage outlet 9 and that a lower portion of its inner wall, extending along the inner wall lower portion of the sack case 24, defines an inclined flow path permitting natural draining. Both the sack 27 and sack case 24 are made of transparent or opaque plastic materials or other transparent materials. Designated at 28 is a draining member for passing water, which is disposed in the neighborhood of the garbage outlet 9, for instance at a position closing substantially the lower half of the garbage outlet 9 under the upper end of the rotary draining cylinder 20, and is provided in its lower portion with a number of draining holes 28***a*. Designated at 29 is a lid removably fitted in the garbage inlet section 5 and having a draining hole 20*a*. Designated at 30 is a lid switch which is adapted to be opened at the time of fitting the lid 29 and closed at the time of removal thereof, and at 31 a safety switch opened and closed with the engagement and disengagement of the pivotal hook member 26 with respect to the hole 23.

The operation of the above construction will now be described. To operate the device, the lid 29 is removed, and a power source switch (not shown) is turned on. With the closure of the lid switch 30 caused by the removal of the lid 29 and also with the closure of the safety switch 31 the motor 12 is energized and rotated to drive the flinging cylinder 16, and hence the rotary blades 19 of the dividing mechanism 17, and the rotary draining cylinder 20. By dropping sink garbage produced by washing vegetables or dishes together with sink water or washing water into the case 4 from the garbage inlet section 5 opened by removing the lid 29, it is finely divided by the dividing mechanism 17 within the garbage dividing chamber 6, and is allowed to drop together with the sink water into the divided garbage disposal chamber 7, where it is received by the rotary draining cylinder 20. The sink water is drained through the draining holes 21 of the draining cylinder 20 by centrifugal forces, while the divided garbage is forced upwards toward the upper end of the rotary draining cylinder 20 and discharged through the garbage outlet 9 into the garbage sack 27. The sink water drained through the draining holes 21 is prevented from entering into the garbage sack 27 by an upper portion of the draining member 28 not provided with holes and allowed to reach and flow aong the bottom of the divided garbage disposal chamber 7 and be appropriately drained through the draining port 10 to a drainpipe or the like. While the sink water and garbage are separated by the rotary draining cylinder 20, part of the sink water may sometimes be caused to enter the garbage sack 27 from the upper end of the rotary draining cylinder 20. Also, sink water not separated from garbage may sometimes be charged together with the garbage into the garbage sack. Therefore, not only garbage but also sink water enters the garbage sack 27. However, since the garbage sack 27 is supported by the sack case 24 such that water inside it can be naturally drained, the sink water entering the garbage sack 27 is allowed to flow along the lower inner surface of the sack 27 toward the lower edge of the garbage outlet 9 and drained through the draining holes 28*a* of the draining member 28 to the draining port 10. It might be thought that the sink garbage is also allowed to flow out together with the sink water at this time, but this does not occur since the garbage is prevented from flowing out of the garbage sack 27 and retained by the draining member 28. After garbage is thus divided and charged into the garbage sack 27, the power source switch is turned off. Subsequently, the pivotal hook member 26 is disengaged from the hole 23, and then the garbage sack case 24 is removed from the garbage outlet 9 by turning the garbage sack case 24 about the pin 22. Then, the garbage sack 27 containing the garbage in the finely divided state is taken out from the garbage sack case 24, and its mouth is suitably sealed by means of a rubber band or a heat sealer, so that it is now ready for being taken away. For the next sink garbage disposal, a new garbage sack is loaded in the garbage sack case 24, which is then mounted on the garbage outlet 9, and the garbage outlet 9 may be covered with the lid 29 until the operation of the device for the next time.

It will be appreciated that, since the above embodiment of the invention is provided with the garbage sack case 24 for supporting the garbage sack 27 for accommodating garbage in the finely divided state such that garbage can be charged into the sack and that water therein can be naturally drained, it is possible to charge the sole garbage into the garbage sack while preventing sink water from remaining. Besides, in the specific construction the draining member 28 is provided in the neighborhood of the garbage outlet 9 to permit passage of only the water naturally drained from the garbage sack 27, it is possible to eliminate the inconvenience that sink garbage flows out from the garbage sack 27. Since only garbage can be reliably collected in the garbage sack 27, the whole volume of the garbage sack 27 can be filled with garbage and the quantity of garbage that can be accommodated in the garbage sack can be increased in comparison to the prior art device which has had the drawback that sink water remains in the garbage sack when once charged. Further, since sink water is not retained in the garbage sack 27, firing disposal of garbage together with the garbage sack 27 can be satisfactorily carried out. Furthermore, since the garbage sack 27 is supported by the sack case 24 such that garbage can be charged into it and that water within it can be naturally drained away, the afore-mentioned operation and effects can be obtained even if the garbage sack 27 is soft and has an idefinite form, that is, the garbage sack used may have either a definite form or a indefinite form, and this is very convenient. Moreover, since the garbage sack 27 is coupled to or removed from the garbage outlet 9 by mounting or removing the sack case 24, there is no need of tediously aligning the mouth of the garbage sack 27 with the garbage outlet 9 when mounting the garbage sack 27, and the coupling and removal of the garbage sack 27 can be readily made.

Further, with the above embodiment in which the garbage sack case 24 and garbage sack 27 are made of a transparent or opaque material, the quantity of garbage charged in the garbage sack 27 can be visually confirmed, which is very convenient. Still further, since in the above embodiment the case 4 is made of a plastic material with the garbage dividing chamber 6 provided with a metal lining 8, it is possible to reduce the weight of the whole construction, facilitate the manufacture, realize painting-free finish, improve the corrosion-resistant property and reduce cost without reducing the mechanical strength of the side wall of the garbage dividing chamber 6.

As has been described in the foregoing, the garbage disposal device according to the invention, which comprises a case having an upper garbage inlet section, a garbage dividing section defined under and communicating with the garbage inlet section, a divided garbage disposal chamber defined under and communicating with the garbage dividing chamber and a garbage outlet formed in the side wall of the garbage dividing chamber, a garbage dividing mechanism disposed within the garbage dividing chamber and driven by a motor for finely dividing garbage, a rotary draining cylinder provided within the garbage dividing chamber such as to receive finely divided garbage from the garbage dividing mechanism and driven by the motor for causing the received garbage to be discharged from the garbage outlet by centrifugal forces and a garbage sack case removably mounted on the garbage outlet and supporting a garbage sack such that the divided garbage can be charged into the sack and that water therein can be naturally drained away, has various excellent effects such as reliably preventing sink water from remaining in the garbage sack, thus increasing the quantity of garbage collected in the garbage sack, permitting the convenience of using a garbage sack of an indefinite form to obtain the afore-mentioned effects and facilitating the coupling and removal of the garbage sack.

What is claimed is:

1. A device for disposing of garbage comprising:

a case having an upper garbage inlet section, a garbage dividing chamber defined under and communicating with said garbage inlet section and a divided garbage disposal chamber defined under and communicating with said garbage dividing chamber, said divided garbage disposal chamber having a garbage outlet formed in its peripheral wall and a draining port for removing water therefrom;

a motor;

a garbage dividing mechanism disposed within said garbage dividing chamber and driven by said motor for finely dividing garbage;

a rotary draining member provided within said garbage disposal chamber to receive finely divided garbage from said garbage dividing mechanism and driven by said motor for causing the received garbage to be discharged from said garbage outlet by centrifugal force; and a garbage sack case supporting a garbage sack in an interior space so that finely divided garbage discharged from said garbage outlet is received in said garbage sack, said case including water passing means between said interior space and said garbage disposal chamber for preventing garbage in said sack from moving into said garbage disposal chamber and said case further defining an inclined flow path for draining away water entering said garbage sack through said water passing means.

2. A device for disposing of garbage according to claim 1, wherein said garbage sack case supports said garbage sack such that a lower inner surface thereof is downwardly inclined toward one end to define said inclined flow path.

3. A device for disposing of garbage according to claim 2, wherein said inclined flow path communicates with said garbage disposal chamber in said case so that water flowing along said inclined flow path is drained through said draining port in said garbage disposal chamber.

4. A device for disposing of garbage according to claim 1, 2 or 3, wherein said garbage sack case is a transparent plastic cylinder having one end open to said garbage outlet of said case and supports said garbage sack such that said garbage sack extends along its inner periphery.

5. A device for disposing of garbage according to claim 1, wherein said garbage dividing mechanism includes a flinging cylinder having a top wall and rotated by said motor about a vertical axis and blades secured to the upper surface of said top wall.

6. A device for disposing of garbage according to claim 5, wherein said rotary draining member coaxially surrounds said flinging cylinder, is coupled at the lower end to the lower end of said flinging cylinder, upwardly flares and has a number of draining holes.

7. A device for disposing of garbage according to claim 1, wherein said case is made of a plastic material, and also wherein said garbage dividing chamber is lined with a metal plate.

* * * * *